US005482186A

United States Patent [19]

Rodden, Jr.

[11] Patent Number: 5,482,186

[45] Date of Patent: Jan. 9, 1996

[54] REMOVABLE LOCK ELEMENT FOR IMMOBILIZING ROTATION OF A TRIGGER SPRAYER NOZZLE

[75] Inventor: Edward J. Rodden, Jr., Upland, Calif.

[73] Assignee: Calmar Inc., City of Industry, Calif.

[21] Appl. No.: 262,272

[22] Filed: Jun. 20, 1994

[51] Int. Cl.[6] ..... B67B 5/00

[52] U.S. Cl. ..... 222/153.07; 222/153.14

[58] Field of Search ..... 222/153.07, 153.13, 222/384, 153.14

[56] References Cited

U.S. PATENT DOCUMENTS

| | | | |
|---|---|---|---|
| 4,424,919 | 1/1984 | Knox et al. | 222/153.13 |
| 4,946,074 | 8/1990 | Grogan | 222/153.13 |
| 4,971,227 | 11/1990 | Knickerbocker et al. . | |
| 5,169,032 | 12/1992 | Steijns et al. . | |
| 5,207,359 | 5/1993 | Steijns . | |
| 5,299,717 | 4/1994 | Geier . | |

*Primary Examiner*—Gregory L. Huson
*Attorney, Agent, or Firm*—Watson, Cole, Grindle & Watson

[57] ABSTRACT

A trigger actuated liquid dispensing pump assembly has a locking mechanism for preventing rotation of the discharge nozzle from its discharge closed position in either direction about its central axis. The locking mechanism comprises a locking element having at least one protrusion extending into a gap formed by a side wall of the shroud cover spaced from an opposing side wall of the trigger lever. A pair of such protrusions may be provided, the second protrusion of the pair extending into another gap formed by an opposing shroud cover side wall and an opposing side wall of the trigger lever. The protrusion or protrusions engage stop means comprising surfaces of the side walls forming the gap or gaps for preventing nozzle rotation in either direction. Alternatively, the locking mechanism has a pair of fingers straddling the trigger lever without underlying the shroud cover side walls, the fingers engaging flat opposing side walls of the trigger for resisting nozzle rotation in either direction about its central axis.

9 Claims, 1 Drawing Sheet

REMOVABLE LOCK ELEMENT FOR IMMOBILIZING ROTATION OF A TRIGGER SPRAYER NOZZLE

BACKGROUND OF THE INVENTION

This invention relates generally to a trigger actuated liquid dispensing pump assembly adapted to be mounted on a container of liquid product to be dispensed, the assembly having a discharge nozzle rotatable between discharge open and closed positions, and more particularly to such an assembly having a removable locking mechanism for immobilizing rotation of the nozzle from its discharged closed position without removal of the locking mechanism. The locking mechanism presents a tamper resistant feature preventing unauthorized dispensing while the assembly is, for example, shelved for retail sale. Also, leakage of product from the assembly during shipment is avoided with the nozzle locked in its discharge closed position.

Manually operated dispensers are known which include locking mechanisms of different types for locking the nozzle in its discharge closed position.

U.S. Pat. No. 4,971,227, commonly owned herewith, discloses a nozzle locking element in the form of a removable tear strip or a removable cover bridging the nozzle cap and the shroud covering the pump body.

U.S. Pat. No. 5,207,359 discloses a tamper evident cover coupled to the trigger lever such that actuation of the trigger will cause the cover to be pulled against the nozzle to cause tensioning and breaking of a frangible connection between the cover and a flange on the cover.

U.S. Pat. No. 5,169,032 discloses a tamper evident pull-away piece detachably connected to a top wall portion of the body of the sprayer assembly, the pull-away piece having fork arms extending into an area between the nozzle cap and the front end of the sprayer body for engaging notches for preventing relative movement between the nozzle cap and the body. Breaking of or removal of the pull-away piece is evidence that the nozzle cap may have been tampered with.

U.S. Pat. No. 5,299,717 discloses a discharge nozzle having a removable locking element snap-fitted to a front face of the trigger lever.

The dispenser according to the invention has a locking mechanism for the nozzle having improved features which enhance the ease and cost of molding and assembly, and the ease and efficiency of operation.

SUMMARY OF THE INVENTION

An objective of the present invention is to provide a manually actuated liquid dispensing pump assembly having a discharge nozzle mounted to the pump body adjacent a forward end of the shroud covering the body for rotation between discharge open and closed positions, and an improved removable locking mechanism to prevent nozzle rotation from its discharged closed position. Removal of the locking mechanism permits nozzle rotation from its discharge closed to its discharge open position.

The locking mechanism is in the form of a locking element removably connected to the nozzle by frangible connecting ties, and has at least one protrusion which may be in the form of a finger or probe extending into a gap formed between a side wall of the shroud cover and a side wall of a trigger lever provided for actuating the pump. The protrusion engages a first stop means comprising the cover side wall or the lever side wall to prevent nozzle rotation in either direction about its central axis from the discharge closed position.

The nozzle may have a second protrusion in the form of another finger or probe extending into another gap formed by an opposing cover side wall and the opposing side wall of the trigger lever. The second protrusion engages a second stop means comprising the opposing cover side wall or the opposing lever side wall in the discharge closed position.

In another embodiment the locking element has a pair of protrusions in the form of fingers straddling the trigger lever and respectively engaging stop means on the lever to prevent rotation of the nozzle from its discharge closed position. Such stop means may comprise flat opposing side walls of the lever to resist nozzle rotation.

Other objects, advantages and novel features of the invention will become more apparent from the following detailed description of the invention when taken in conjunction with the accompanying drawings.

DESCRIPTION OF THE INVENTION

Figure 1:
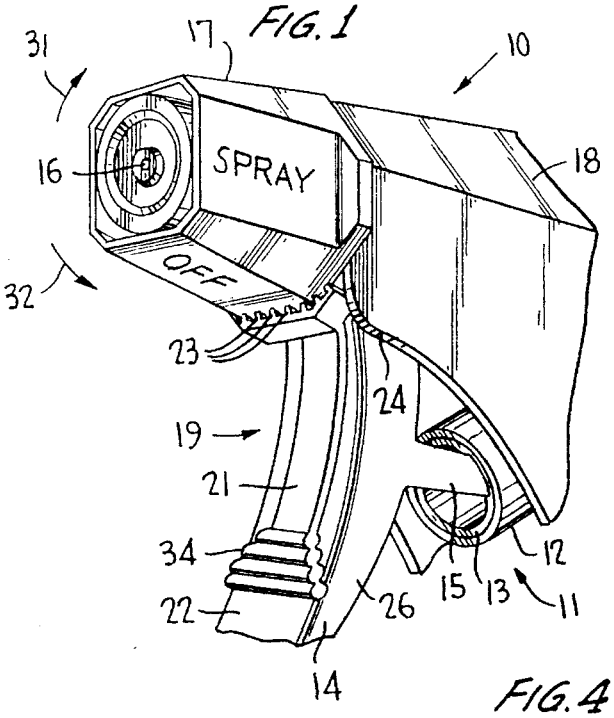
FIG. 1 is a perspective view of part of a trigger actuated liquid dispensing pump assembly having a removable locking element in accordance with one embodiment of the invention.
Figure 2:
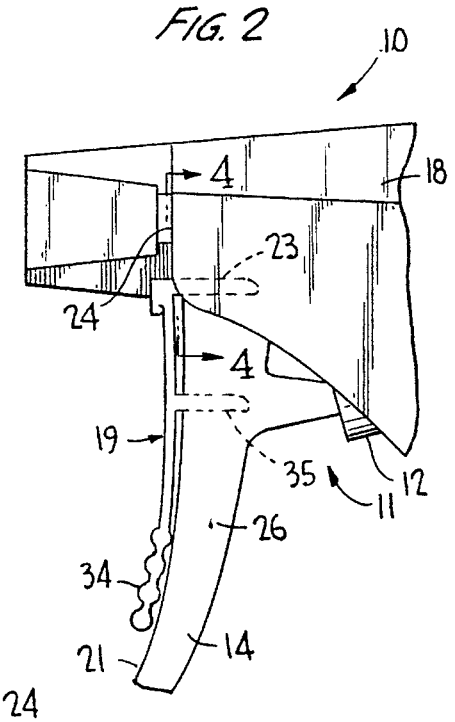
FIG. 2 is a side elevational view of the dispensing pump assembly of FIG. 1 showing in phantom outline another embodiment of the invention.

Turning now to the drawings wherein like reference characters refer to like and corresponding parts throughout the several views, the trigger actuated liquid dispensing pump assembly incorporating the invention is generally designated 10 in FIGS. 1 and 2, and comprises a pump body 11 which includes a pump cylinder 12 containing a pump piston 13, and a trigger lever 14 having a tup engaging the pump piston for reciprocating the same upon trigger actuation to effect the spray of liquid product through a discharge orifice 16 located in discharge nozzle 17 mounted for rotation on the pump body in a known manner. The pump assembly is mounted to a container (not shown) of liquid product to be dispensed, and other parts of the pump assembly are not illustrated for the sake of clarity.

A shroud 18 covers the pump body, and the trigger lever is mounted on the pump body for rotation between discharge open and closed positions, i.e., SPRAY/STREAM and OFF, upon manual rotation of the nozzle about its central axis.

The locking element 19 of the invention has a finger pull tab 21 overlying front face 22 of the trigger lever, the locking element being removably connected to the discharge nozzle by a series of frangible, spaced connecting ties 23, as shown in FIG. 1.

Figure 3:
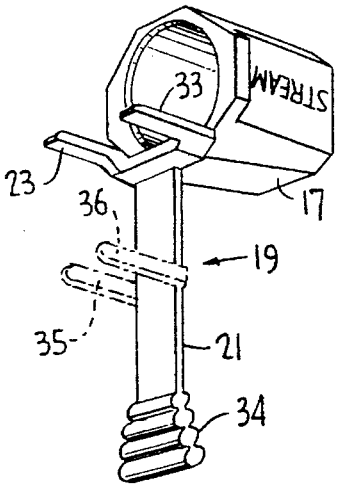
FIG. 3 is a perspective view of the locking element shown connected to the discharge nozzle removed from the pump assembly of FIG. 2 for clarity.
Figure 5:
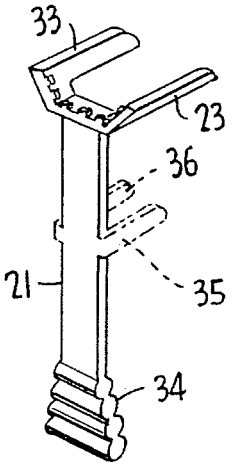
FIG. 5 is a view similar to FIG. 3, in reverse, showing the locking element when removed from the nozzle.

The locking element has at least one protrusion which may be in the form of a rearwardly extending finger 23 at its upper end adjacent the nozzle, as shown in FIGS. 2, 3 and 5.

Shroud cover 18 has opposing side walls 24, 25 overlying an upper portion of the trigger actuator, the discharge nozzle being mounted adjacent the forward end for the shroud cover, as shown. The trigger lever has flat opposing side walls 26, 27, side walls 24, 25 of the shroud cover being respectively spaced from walls 26, 27 to form open gaps 28, 29 therewith (see FIG. 4).

In the attached position of the locking element shown in FIGS. 1 and 2, finger 23 extends into gap 28 and engages stop means for preventing nozzle rotation in either direction about its central axis. The stop means comprises the confronting side walls 24 and 26. Thus, nozzle rotation in the direction of arrow 31 of FIG. 1 is resisted upon engagement of finger 23 against side wall 26 and resistance to nozzle rotation in the direction of arrow 32 is resisted upon engagement of finger 23 against wall 24.

Figure 4:
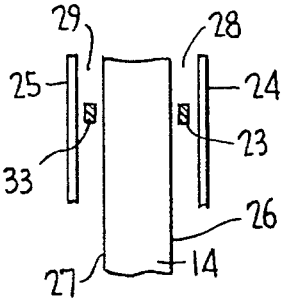
FIG. 4 is a view taken substantially along the line 4—4 of FIG. 2.

The locking element may have another protrusion which may be in the form of a finger 33 likewise located at the upper end of pull tab 21 adjacent the nozzle and extending rearwardly into gap 29, as shown in FIG. 4. Fingers 33 and 23 straddle the trigger lever, and finger 33 engages second stop means to further resist nozzle rotation about its central axis in either direction. Thus, rotation of the nozzle in the direction of arrow 31 is resisted by finger 33 engaging wall 25, and nozzle rotation in the direction of arrow 32 is resisted upon finger 33 engaging wall 27. It should be pointed out that the size of each gap 28 and 29 in FIG. 4 is exaggerated for clarity, and that fingers 23 and 33 when extending into the gaps may contact or be only slightly spaced from the opposing walls forming the gaps, without departing from the invention.

Finger pull tab 21 may be knurled or roughened at its lower end as at 34 to assist the user in easily grasping the pull tab of the locking element and applying a pulling force in a direction away from front face 22 of the trigger lever to break the frangible connecting ties 23 and remove the locking element together with its finger 23 or fingers 23, 33 out of engagement with the respective stop means to thereby permit nozzle rotation in either direction from its OFF position to its SPRAY or STREAM positions. The locking element after removal is illustrated in FIG. 5.

In accordance with another embodiment of the invention, fingers 23 or 23, 33 may be eliminated, and a pair of protrusions which may be in the form of fingers 35 and 36, shown in phantom outline in FIGS. 2 and 3, may be formed on pull lever 21 to extend rearwardly in straddling relationship with trigger lever 14 so as to engage opposing side walls 26 and 27 thereof. The trigger side walls thus define stop means preventing nozzle rotation in either direction 31 or 32 about its central axis. As shown in FIG. 2, fingers 35, 36 do not underlie side walls 24, 25 of the shroud cover such that a pair of such fingers 35, 36 is needed to lock the nozzle against rotation in either direction about its central axis.

In view of the foregoing it can be seen that the locking mechanism for the discharge nozzle of a trigger actuated liquid dispensing pump assembly has been devised for effectively resisting rotation of the discharge nozzle in either direction about its central axis without the need for complicated structure and without any redesign and restructuring of an existing dispensing pump assembly. The locking element with its fingers or protrusions is easy to mold and assemble, yet is highly effective for the purpose intended.

What is claimed is:

1. A trigger actuated liquid dispensing pump assembly, comprising: a pump body including a shroud cover; a discharge nozzle mounted to said body adjacent a forward end of said shroud cover for rotation between discharge open and closed positions upon manual rotation of said nozzle in either direction about a central axis thereof; a trigger lever having opposed side walls said lever being movably mounted to said body for operating a pumping mechanism upon actuation thereof; said cover having opposing side walls spaced outwardly of and respectively forming first and second gaps with said lever side walls; a locking element removably connected to said nozzle by frangible connecting ties; said locking element having at least first means extending into said first gap; said first means engaging first stop means comprising one of said cover side walls and one of said lever side walls in the discharge closed position to prevent rotation of the nozzle in said either direction; and said element being disengaged from said stop means by removal of said locking element from said assembly.

2. The assembly according to claim 1, wherein said locking element has second means extending into said second gap; said second means engaging second stop means comprising the other of said cover side walls and the other of said lever side walls in the discharge closed position.

3. The assembly according to claim 1, wherein said first and second means comprise fingers straddling said lever.

4. The assembly according to claim 2, wherein said first and second means comprise fingers straddling said lever.

5. The assembly according to claim 1, wherein said removable element includes a finger pull tab to facilitate removal.

6. The assembly according to claim 2, wherein said removable element includes a finger pull tab to facilitate removal.

7. A trigger actuated liquid dispensing pump assembly, comprising: a pump body including a shroud cover; a discharge nozzle mounted to said body adjacent a forward end of said shroud cover for rotation between discharge open and closed positions upon manual rotation of said nozzle in either direction about a central axis thereof; a trigger lever movably mounted to said body for operating a pumping mechanism upon actuation thereof; a locking element comprising a finger pull tab removably connected to said nozzle; said locking element having first and second fingers straddling said lever and respectively engaging opposing side walls of said lever, without being coupled to said lever, solely to prevent rotation of said nozzle in said either direction from the discharge closed position; said fingers being connected to opposing side edges of said tab, and said element being removable to permit the rotation of said nozzle between said discharge open and closed positions.

8. The assembly according to claim 7, wherein said locking element is removably connected to said nozzle by frangible connecting ties.

9. The assembly according to claim 7, wherein said pull tab overlies a front face of said lever.

* * * * *